US009183711B2

(12) United States Patent
Fiorini et al.

(10) Patent No.: US 9,183,711 B2
(45) Date of Patent: Nov. 10, 2015

(54) ANTI-PIRACY SYSTEM FOR THE MARITIME NAVIGATION IN CRITICAL AREAS, AND DEVICE FOR DATA EXTRACTION FROM ON BOARD SENSORS

(75) Inventors: Michele Fiorini, Rome (IT); Giovanni Graziano, Rome (IT); Alberto Rulli, Rome (IT); Paolo Bodo di Albaretto, Rome (IT)

(73) Assignee: SELEX SISTEMI INTEGRATI S.P.A., Rome (IT)

( * ) Notice: Subject to any disclaimer, the term of this patent is extended or adjusted under 35 U.S.C. 154(b) by 496 days.

(21) Appl. No.: 13/813,910

(22) PCT Filed: Aug. 3, 2011

(86) PCT No.: PCT/IT2011/000286

§ 371 (c)(1),
(2), (4) Date: May 3, 2013

(87) PCT Pub. No.: WO2012/017470

PCT Pub. Date: Feb. 9, 2012

(65) Prior Publication Data

US 2013/0215272 A1 Aug. 22, 2013

(30) Foreign Application Priority Data

Aug. 3, 2010 (IT) ..... RM2010A0433
Aug. 3, 2010 (IT) ..... RM2010A0434

(51) Int. Cl.

| | |
|---|---|
| ***G08B 23/00*** | (2006.01) |
| ***G08B 13/00*** | (2006.01) |
| ***G08G 3/00*** | (2006.01) |
| ***G08G 5/00*** | (2006.01) |

(52) U.S. Cl.
CPC *G08B 13/00* (2013.01); *G08G 3/00* (2013.01); *G08G 5/0086* (2013.01)

(58) Field of Classification Search
CPC ..... G08B 13/00; G08G 3/00
USPC ..... 340/984, 502, 505, 539.13, 5.1, 5.8; 348/148; 370/328; 342/454; 375/324; 701/300; 455/456.1
See application file for complete search history.

(56) References Cited

U.S. PATENT DOCUMENTS

2003/0233176 A1 12/2003 Cerchione
2008/0079608 A1 4/2008 Morrell (Continued)

OTHER PUBLICATIONS

Anonymous, "Guidelines on AIS as a VTS tool," IALA/AISM (Dec. 2001) 1-16.

(Continued)

*Primary Examiner* — Toan N Pham
(74) *Attorney, Agent, or Firm* — Volpe and Koenig, P.C.

(57) ABSTRACT

The invention concerns a maritime anti-piracy system, for the recognition of suspect watercrafts around one or more co-operating ships to be protected. The system includes a shore-based control system having one or more centers, geographically distributed, with shore sensors for detecting watercrafts surveillance data. The system also includes a central station for collecting and elaborating watercrafts surveillance data and a bi-directional communication network between the one or more centers and the central station, in such a way that the central station be able to send commands to the shore-based sensors. The system also includes a communication system between the one or more centers and the one or more co-operating ships to be protected.

22 Claims, 3 Drawing Sheets

(56) References Cited

U.S. PATENT DOCUMENTS

| | | | | |
|---|---|---|---|---|
| 2008/0086267 | A1* | 4/2008 | Stolte et al. | 701/300 |
| 2009/0045983 | A1 | 2/2009 | Miller | |
| 2009/0161797 | A1* | 6/2009 | Cowles et al. | 375/324 |
| 2014/0128098 | A1* | 5/2014 | Behrens et al. | 455/456.1 |
| 2015/0166163 | A1* | 6/2015 | Longson et al. | 340/984 |

OTHER PUBLICATIONS

Marin Chintoan-Uta, "Operational use of satellite SAR at EMSA," EMSA (Jan. 25, 2010) 1-45.

* cited by examiner

ANTI-PIRACY SYSTEM FOR THE MARITIME NAVIGATION IN CRITICAL AREAS, AND DEVICE FOR DATA EXTRACTION FROM ON BOARD SENSORS

This application is a 35 U.S.C. §371 national phase application of PCT/IT2011/000286, which was filed Aug. 3, 2011 and is incorporated herein by reference as if fully set forth.

The present invention concerns an anti-piracy system for the maritime navigation in critical areas, and device for data extraction from on board sensors.

More in detail, the present invention concerns an anti-piracy maritime system based on the analysis and tracking of targets. Such a system takes into account different information sources, to provide to the final user a secure navigation channel within a critical area and more in general in the Economic Exclusive Zone (EEZ), managed by costal centres or VTS (Vessel Traffic Services) systems. The invention further concerns a device for data extraction from sensors on board of ship that is utilized in the system of the invention.

In the last 10 years, the Applicant has developed, among others, the following products: the Vessel Traffic Service (VTS) and the Vessel Traffic Management Service (VTMS), exploiting the research and know-how patrimony gained in the defence of critical missions and in the Air Traffic Control" (ATC) fields, wherein the society is committed in the delivery of all-in-one systems, with respect to a large ensemble of consumers all over the world. The VTS and maritime traffic control systems have been installed all over Italy, including a particular system for the management of the traffic in the lagoon of Venice and in various countries of the world, including Russia, China, Poland, Yemen and recently Turkey and Panama. Moreover, the river version of the same systems, for the control of river traffic, is being installed in Serbia on the Danube river.

When an electronic system based on sensors coupled with extensive database processing capabilities, the product of the Applicant is called Vessel Traffic Management and Information System (VTMIS).

The Applicant is being currently implementing the Italian national VTS system which comprises:

73 radar sites;
3 mobile radar units;
39 local control centres;
14 regional centres;
1 national centre;
1 training centre.

The system has a control and command organization at multiple levels, a redundant coverage of critical areas, the possibility of integrating data/services or Exchange them with a certain number of external (both civil and military) organizations: an important example of this integration ability is given by the interconnection and exchange of data between the National Vessel Travel Service (NVTS) and the National Coastal Surveillance System (NCSS), entirely managed by the Italian Military Navy.

From 1990 the Applicant is actively present in the main International commission (IMO—International Maritime Organization, IALA—AISM International Association of Marine Aids to Navigation and Lighthouse Authorities, European projects, etc.), its maritime business has naturally evolved to satisfy the recent market needs, including improvements to the Vessel Traffic Management (VTM), e-Navigation, LRIT (Long Range Identification and Tracking), coastal surveillance, river navigation surveillance and management and portal security systems.

The marine piracy has doubled in 2009 as indicated by the International Maritime Bureau (IMB). The IMB believes that the escalation of the piracy will have significant economical consequences for the emerging economies countries. As a consequence, these Countries should adopt a system to secure certain commercial routes to avoid threats and establish an IMB Piracy Reporting Centre (PRC) in Kuala Lumpur, Malaysia. Most part of the reports is relevant to the increase of the activity in the Aden gulf and in the Somalian coastal waters, wherein more than 150 accidents occurred in the past year.

The patent document US2009045983 describes a sea fried/foe recognition system is described (WFSS) which utilizes a SIM ("Subscriber Identity Module") card with a SIM reader on board of a watercraft. A transmitter, which is coupled with the SIM reader, transmits information from the SIM card, as well as positioning information, to a tracking station of the system. The advantage of this system would be that of prevent non-authorised modifications of the watercraft information when utilised together with the AIS standard, as well as the auto-identification of a large number of watercrafts without remaking the global AIS & GMDSS standards. However, the transmission of the ID but not of all the authentication of all the AIS messages by the key relevant to the ID is described. In particular, one an RFID is utilized, for the ID information and such an information is transferred unencrypted through the AIS. All this presupposes a network infrastructure (GSM o equivalent) currently present only near the coasts.

The patent US 2003233176 describes a maritime data collection and distribution system comprising a ship configured to transmit a signal (by satellite) corresponding to the current position of the ship, or to the foreseen position of the ship, a computer network including one or more databases, each one comprising one or more interest zones, wherein the interest data zone corresponds to a controller zone, and a services provider configured to receive the signal, recuperate one or more data of interest zones from the computer network on the basis of the signal and transmit to the ship one or more zone of interest data for the ship. The zone of interest data is constituted by maritime that are favourable to a secure and economical utilization of the ship. The interested zone is a three-dimensional area surrounding the ship or a time-limited zone surrounding the ship.

The patent document US 2008079608 describes a method for the optimization of the programming of the ships entering and editing into/out of the port, the method comprising the steps of:

a. combining the information from an automated identification system on each ship with the planning of information on each ship from a sending system to produce a combined programming/ID for each ship;
b. tracking the latitude and longitude of each ship by GPS for the production of latitude and longitude tracked for each ship;
c. comparing tracked latitude and longitude of each ship with the existing port maps;
d. continuously comparing the programming/ID for each ship with the tracked latitude and longitude of each ship.

The signalling are sent each time that the tracked latitude and longitude do not correspond to the expected latitude and longitude of each ship in a given instant. The method tracks and records each time a pilot embark or disembark from a ship.

It is object of the present invention an advanced anti-piracy system that adapts perfectly to the functional VTMS architectures and constitutes a complementary function for the defence of extended areas that are threatened by pirates or terrorists. The system object of the invention can also be utilized in all the control systems for boundary, national security/protection and Exclusive Economic Zone (EEZ).

It is subject-matter of the present invention a maritime anti-piracy system, for the recognition of suspect watercrafts around one or more co-operating ships to be protected, comprising:

a shore-based control system, comprising:

one or more centres, geographically distributed, comprising shore sensors for detecting watercrafts surveillance data;

a central station for collecting and elaborating watercrafts surveillance data;

the shore-based control system comprising a bi-directional communication network between said one or more centres and said central station, in such a way that the central station be able to send commands to said shore-based sensors;

a communication system between said one or more centres and said one or more co-operating ships to be protected, The anti-piracy system being characterised in that it comprises:

one or more devices, mounted on board of corresponding said one or more co-operating ships to be protected, for maritime surveillance data extraction from maritime surveillance sensors, which are mounted on board of corresponding said one or more co-operating ships to be protected and are suitable to watch over the space around said one or more co-operating ships, said one or more devices for data extraction being suitable to send said maritime surveillance data to at least one of said one or more centres through said communication system;

an identification and authentication system of said one or more co-operating ships to be protected, which functions through said communication system and is shared among said one or more centres and each of said one or more co-operating ships to be protected, Said central station for collecting and elaborating data elaborating the data coming from said one or more centres, and therefore also from said one or more co-operating ships to be protected, and launching the relevant alarms in the case of recognition of suspected watercrafts.

Here by "maritime surveillance" is meant the watching over the watercrafts in a maritime zone.

The elaboration performer by the central station can comprise the crossing of all the data in order to individuate the suspected watercraft or recognize watercrafts silhouettes that are not among the forms of the co-operating ships, with particular reference to the processing of the kinematics of all the watercrafts to the end of assigning to each one of them a threat level that can be simplistically be friend, foe, neutral, based on heuristics and intelligent systems that learn and improve by experience the reliability of the proposed result.

Preferably according to the invention, said maritime surveillance sensors comprise the radar mounted on board of said one or more co-operating ships to be protected.

In such a way, by enlarging, by means of the on-board radar and optionally also the camera(s), the coverage of the shore systems, one drastically decrease the reaction times for the possible counter-measures (time factor is fundamental as above mentioned).

Preferably according to the invention, said identification and authentication system comprises one or more AIS transmission devices mounted on corresponding said one or more co-operating ships, and at least a shore AIS receiving device, said one or more AIS transmission devices being suitable to transmit information of authentication of the identity of said corresponding said one or more co-operating ships to said at least a shore AIS receiving device.

Preferably according to the invention, to each of said one or more AIS transmission devices and said at least a shore AIS receiving device an encryption unit is associated, which generates a key for the authentication of the AIS messages, without changing the structure of the exchanges messages, i.e. within the AIS systems standards.

Preferably according to the invention, said identification and authentication system comprises or is constituted by a VHF communication with encrypted signature.

Preferably according to the invention, said shore-based sensors comprise at least a shore camera and said maritime surveillance sensors comprise at least a camera, said central station elaborating the video data coming from said shore-based sensors and said maritime surveillance sensors to obtain watercrafts video tracks, including said suspected watercrafts and said one or more co-operating ships, which are elaborated together with at least a track coming from said at least a shore AIS receiving device and said radar relevant to the same watercrafts, to the end of improving the recognition of the same watercrafts.

This is a novelty in the field, because till now the electro-optic information have not been integrated with the radar ones. One can integrate the data from shore cameras and/or on-board cameras. In particular, one integrates information coming from the optical analysis of the video fluxes of the (high-sensibility, daily and infrared) cameras with the information obtained from the processing of the electro-magnetic signals provided by radars and the AIS radar signals.

Preferably according to the invention, said central station elaborates video data from camera to additionally obtain the watercrafts silhouettes and compares them with a series of pre-defined silhouettes relevant to known ships.

This increase the confidence of the recognition and adds silhouette information of the watercraft under examination. This is a novelty as well, since as yet the recognition of the watercraft silhouette has been committed to analysis of satellite data of difficult (and expensive) realization and certainly not in quasi-real-time. Typically one collects satellite data for a long time period and then elaborates them off-line, obtaining the silhouettes of the watercrafts under examination.

One integrates thus information from the optical analysis of the video streams of the (high-sensibility, daily and infrared) cameras with the information obtained from the elaboration of the electro-magnetic signals provided by the radars and the AIS radar signals.

Preferably according to the invention, each of said one or more devices for data extraction comprises:

a module for connecting to said maritime surveillance sensors, by means of data bus or by direct connection;

a gateway module for connecting to a data transmission module mounted on board of said one or more co-operating ships for the sending of the extracted data to shore through said communication system.

Without the direct connection module (tracker), one looses the great many cases wherein there are watercrafts that works with a format which is not standard and cannot therefore transmit to shore the data obtained from the on board sensors (the human operator in such a case communicates the recognition, for example by phone).

Thanks to the device according to the invention, one enlarge the action range of the maritime localization (watching), since the on board sensors extend and detail the localization beyond the range of the shore sensors.

Preferably according to the invention, each of said one or more devices for data extraction comprises an extracted data elaboration module, which is suitable to prepare elaborated data to be transmitted through said gateway module.

Preferably according to the invention, extracted data elaboration module functions also as on board tracker, in particular in the case of data extracted from on board radar sensors.

Indeed many ships work with a non-standard format, failing said tracking module, and therefore they cannot transmit the data obtained from on board sensors (the human operator, in such a case, has to communicate the recognition, for example by phone).

Thanks to the device according to the invention, one enlarge the action range of the maritime localization (watching), since the on board sensors extend and detail the localization beyond the range of the shore sensors.

Preferably according to the invention, said gateway module is suitable to operate towards a VHF radio data transmission module mounted on board of said one or more co-operating ships.

Preferably according to the invention, said gateway module is suitable to operate towards a satellite and/or UNHF radio transmission module, mounted on board of each of said one or more co-operating ships for sending of data to shore control system.

Preferably according to the invention, said gateway module comprises a sub-module for the management of commands and parameters relevant to the radio communication, such as for example the hand-over in the selection of the frequencies and radio channels to be utilised in said communication system.

Preferably according to the invention, each of said one or more devices comprises two modules of connection to said maritime surveillance sensors:

- a direct connection module, which extracts the data and represents them in a pre-defined format;
- a bus indirect connection module (ETH), which is a sniffer for data extraction and data representation in a standard protocol.

Preferably according to the invention, said identification and authentication system utilises indifferently either message No. 8 or 6 of the AIS standard, being provided electronic elaboration means which append a secret information to the string of the 24 AIS messages and calculate a hash of the whole string so obtained, said a hash being inserted in the said either message 8 or 6, the string of 24 messages so obtained being finally sent through said communication system Preferably according to the invention, said secret information is a cryptographic key.

Preferably according to the invention, each of said one or more devices utilises a GPS and a geographical localisation module, which is suitable to detect any deviation of the corresponding co-operating ship to be protected from the boundaries of a pre-determined secure area and/or the navigation plan in case of capture of the co-operating ship by pirates, and is also suitable to transmit such deviation to a shore-based control system.

It is further subject-matter of the present invention a device for maritime surveillance data extraction from maritime surveillance sensors mounted on a ship, characterised in that it comprises:

a module for connecting to said maritime surveillance sensors, by means of data bus or by direct connection;

a gateway module for connecting to a data transmission module mounted on board of the ship for the sending of the extracted data to a shore centre through said communication system.

Preferably according to the invention, the device comprises a extracted data elaboration module, suitable to prepare elaborated data to be transmitted through said gateway module.

Preferably according to the invention, said extracted data elaboration module functions also as an on board tracker, in particular in the case of data extracted from on board radar sensors.

Preferably according to the invention, said gateway module is suitable to operate towards a VHF radio data transmission module mounted on board of said ship.

Preferably according to the invention, said gateway module is suitable to operate towards a satellite and/or UNHF radio transmission module, mounted on board of said ships for sending of data to shore.

Preferably according to the invention, said modulo gateway comprises a sub-module for the management of commands and parameters relevant to the radio communication, such as for example the hand-over in the selection of the frequencies and radio channels to be utilised in the communication to shore.

Preferably according to the invention, the device comprises two modules for connection to said maritime surveillance sensors:

- a direct connection module, which extracts the data and represents them in a pre-defined format;
- a bus indirect connection module (ETH), which is a sniffer for data extraction and data representation in a standard protocol.

The invention will be now described, by way of illustration but not by way of limitation, making reference to the figures of the attached drawings, in cui:

Figure 4:
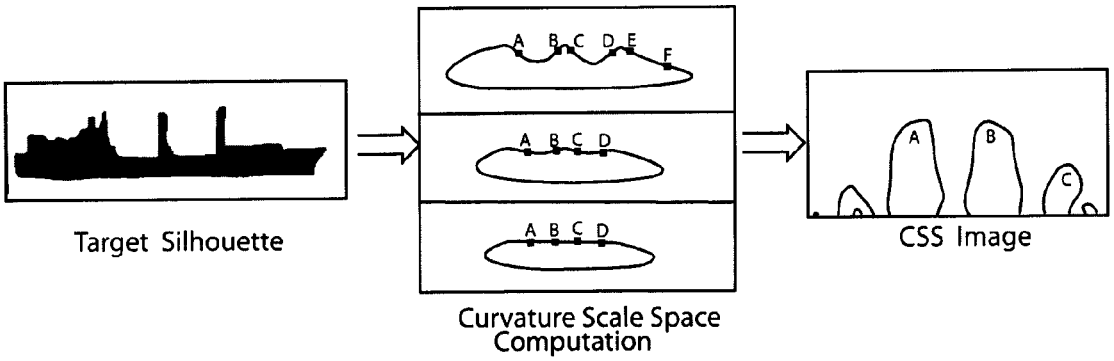
Figure 5:
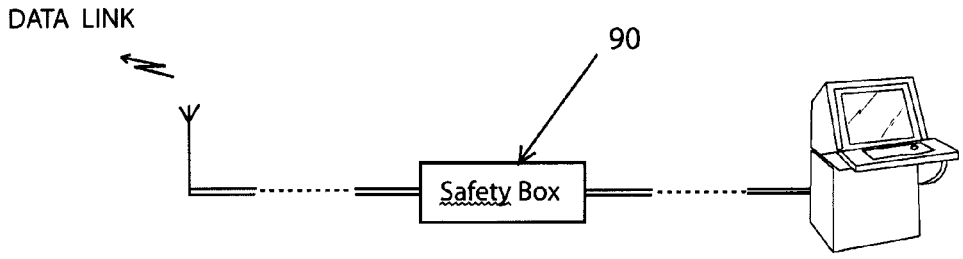
Figure 6:
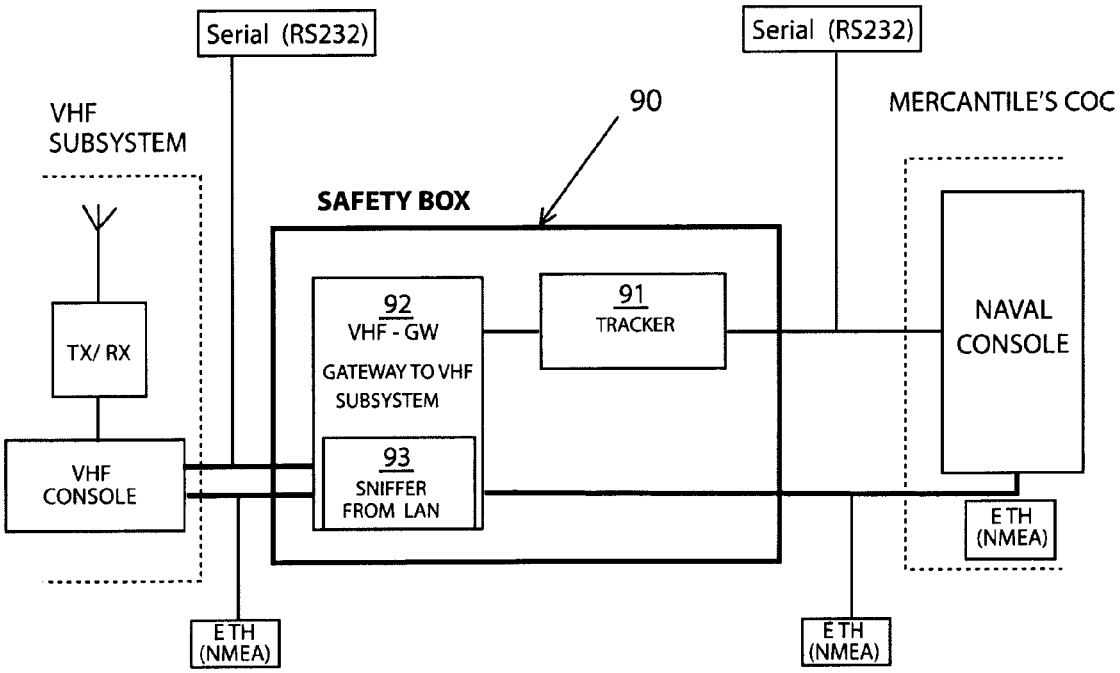

la FIG. 4 shows the features extraction technique for the classification of ships;

la FIG. 5 shows the connection of a "safety box" device according to the invention;

la FIG. 6 shows the modules of the safety box according to the invention.

The function performer by the system 100 according to the present invention (anti-naval-piracy function) is based on the analysis and tracking of targets based on various sources of information about scattered targets 30, 31, 50, to provide to the final user the possibility of obtaining a secure navigation channel in the economic exclusive zone EEZ, managed by the VTS centres or equivalent coastal centres.

Figure 1:
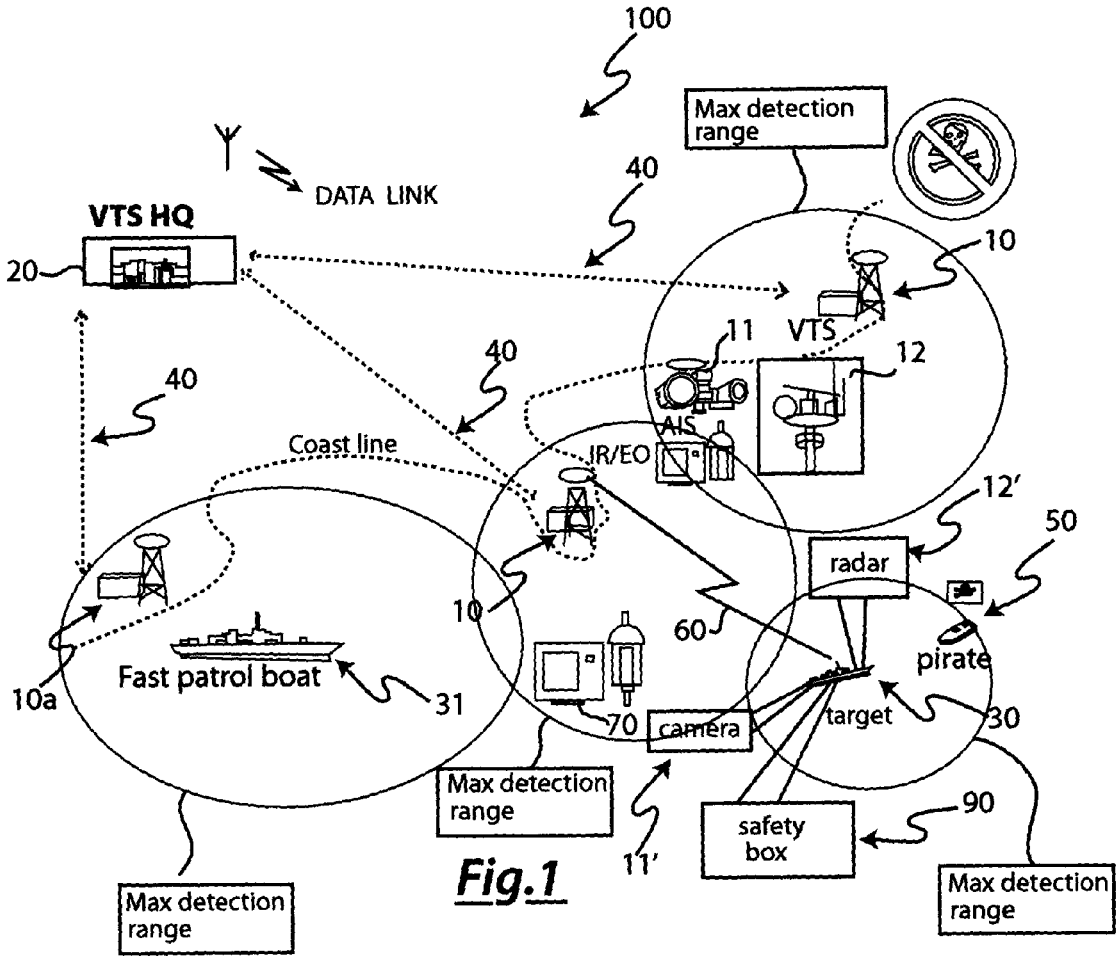
FIG. 1 shows the general architecture of the system according to the invention.
Figure 2:
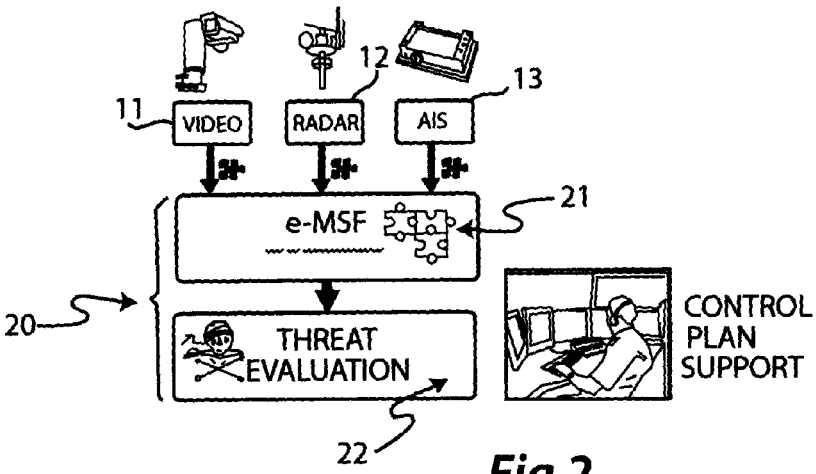
FIG. 2 shows the information elaboration flow in the system according to the invention (shore part)

Making reference to FIG. 2, the system utilizes, according to a preferred embodiment, three different data sources:

cameras 11 (typically high-sensitivity cameras adapted to low level of light and infrared) to the ground and/or on-board level;

shore radar 12 and on board radar 12';

Automatic Identification System AIS 13.

Traditionally, only the shore radar and more recently the AIS have been utilized to obtain the position of the target and its identification. Such traditional systems have the disadvantage of using only kinematics data and therefore do not allow a precise identification of the watercrafts of various nature (commercial or potentially pirate) in the watched zone. The AIS is mandatory only on big ships larger than 15t, therefore the potentially more dangerous small targets can be detected only by the radar that does not allow a precise identification since it manages only kinematics information.

The system according to the invention instead utilizes also the data coming from the ship's radar, and optionally from the cameras at shore level and/or on board, to allow the improving of the data fusion coming from all the sensors, and therefore improve the possibility of a correct identification and positioning both of the watched ship and the watercrafts surrounding it to the end of effect an early warning about the presence of potential pirate threats.

It should also be observed that within an area already surveilled by a classical VTS system, the present invention provides the anti-piracy functionality without the necessity of adding additional sensors in the surveillance area (owing to the fact that each interesting watercraft already possesses at least an on-board radar). It makes use of complementary information coming from different sensors (radar, AIS, cameras).

It is here to be stressed that the use of the only on-board radar to anti-piracy ends is all alone already a remarkable innovation with respect to the prior art, because this extends the radar investigation field without the need of mounting additional sensors on any part of the system. As we will see in the following, this functionality is assured by the "safety box" (or device 90 for extraction of maritime surveillance data) according to the invention, which optionally can also exploit the data from on-board camera.

On a real scenario, the following statements are true:

the AIS 70 is mandatory usually for ships larger than 15 t in accordance with the IMO regulation and therefore does not provide any information for the smaller ships;

the AIS 70 could be illicitly manipulated to provide deceptive information;

the radar 12 or that on board 12' provide kinematic information, usually without information concerning the identity of the targets of the same targets (for example, it is difficult to discriminate, with the help of the only radar, between a still small watercraft and a buoy);

the shore camera 11 or those on board provide the video information about the target wherefrom the identification data for any specific target can be extracted (in the above example, the possibility of adding the optical information, by means of the use of the cameras, to the radar data allows to discriminate immediately between a still ship even if of small size and a buoy).

The input data are elaborated in a module called enhanced Multi Sensor data Fusion module (e-MSF) 21 to the end of providing an evaluation of the threat corresponding to the operative scenario 22, that is used by the operator of the shore headquarter 20.

Shore-Based Level

The shore-based level (first level) 20 is installed in the calculation nodes of the VTS system or equivalent system of coastal surveillance and is devoted to the performing of the anti-piracy functionalities mentioned in the following, which have as input the radar 12,12', the AIS 13 ("Automatic Identification System") and the electro-optical data 11,11' as shown in FIG. 2. This level comprises therefore the data received from the sensors of the co-operating ship.

Figure 3:
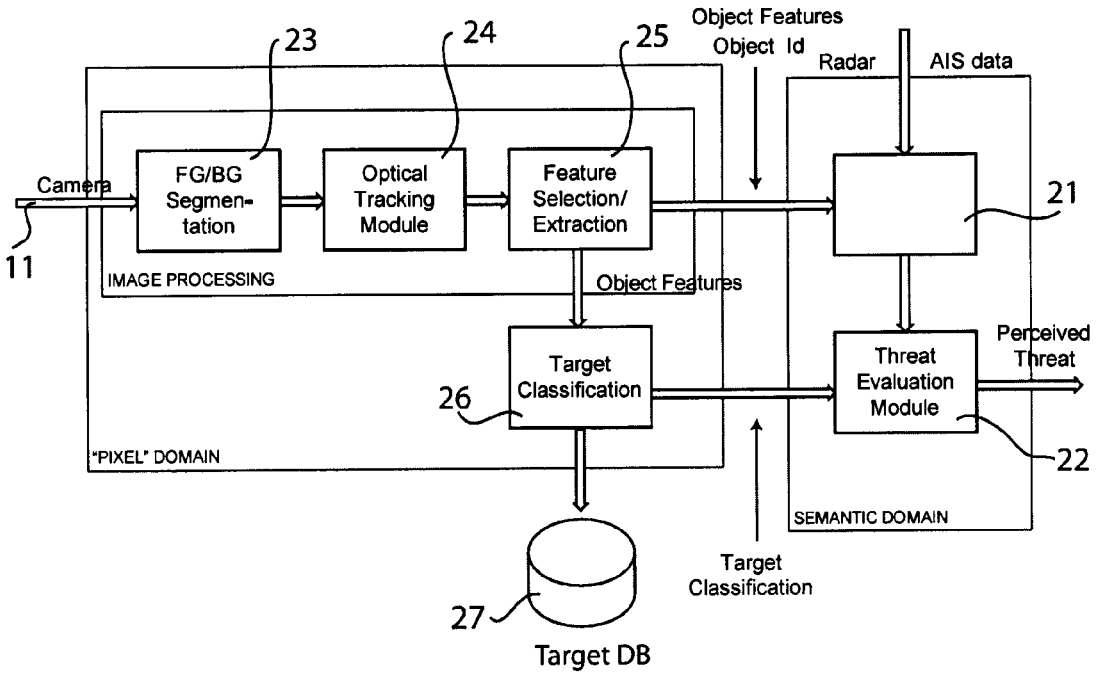
FIG. 3 shows a video processing elaboration chain, in the pixel domain, i.e. optical domain, (segmentation of background/foreground, object tracking and classification/extraction of features to the semantic domain (data fusion and scene description) according to the invention.

The processing of the optical images 11,11' defines video signals elaboration steps from levels of low semantic significance (raw data flow coming from the camera(s)) to the semantically more descriptive levels. This electro-optical process is composed by (cf. FIG. 3):

a module of segmentation 23 whose aim is the isolation of the interest targets from the background;

a module of optical tracking 24 whose aim is to attribute to each of the objects isolated in the previous step an univocal identifier that is needed for identifying the same object in subsequent images of the video flow;

a feature extraction module 25 whose aim is the calculation of the main features of the isolated targets;

a module of target classification 26 that works on the target silhouettes. The features obtained from the feature extraction module (license plate, colour, form) are the input for this module, which will compare the target silhouette with the ships silhouettes in a reference database (DB) 27 (cf. FIG. 4).

After the step of image elaboration, the system according to the invention effects the fusion of the optical information with AIS and radar information, in the e-MSF module 21. To this end, an algorithm has been developed to use optical data in the fusion process. The difficulty of such process is that of correctly associate the image data with the corresponding AIS or radar tracks, since the image data do not contain the distance information. To overcome this difficulty, an algorithm has been implemented, which uses geo-referenced reference points that are defined by operator and, by means of geometrical transformations, succeeds to associate positional information to an optical target.

The data fusion has a twofold functionality: on one hand, information are associated to the target, which are functional to the subsequent threat evaluation processes 22 (see below), on the other hand the interaction with the optical images allows to validate the radar information. The validation scheme provides that, starting from the single radar track, once the cameras are positioned so as to frame the point where the same radar track finds itself, the traditional algorithms for object detection are executed, in such a way to verify effectively that the radar track is corresponding to a watercraft.

As already said, after the data fusion process, each track is associated to information of position (AIS o radar) and therefore each target is also correlated with extension data (length, height).

Starting from all the available information:

data deriving from video (license plate, colour, form);

radar or AIS kinematic data (position, course and speed);

data relevant to the union of radar/AIS and video position information (length, height);

data that come from available archives (for example Lloyd's o other watercrafts databases), The threat evaluation module can operate in two modes.

In the first mode, the system is trained to recognize anomalous behaviours without the intervention of the operator. In such a mode, the operator should only define important features to track (for example position, speed and course) and the system will:

1) learn (off-line) the "normal" behaviour of the system (in order to make the system understand what a normal behaviour is, the system is trained on real data without anomalous situations);
2) detect anomalous situations comparing the current data with the data utilized during the training sessions.

In the second mode, the operator defines (buy using a language with pre-defined rules) the anomalous situation that it wish to prevent.

The utilized technology to implement such a system is based on the Description Logics (DL). The Knowledge Based (KB) system will contain a pre-defined assertions set (usually called T-box assertions) constructed (only once) by person skilled in the art. The data coming from the sensors, once suitable elaborated, will provide information on the actual state of the system (A-box assertion). Starting from these structures, the system will provide a semantic description of the current situation.

On the basis of the evaluation of the threat 22, the anti-piracy function is directly activated and managed by the component of support to decision of the VTS system or equivalent coastal control centre, for:

indicating the tools more adapted to face the threat;

indicating the minimum path to reach the sensible target;

evaluating the possible escape path and starting the hunting mission.

Connection of Secure Communication (Second Level)

The secure connection level 60 defines a secure approach path through a secure transit channel (of any extension and form, possibly even an area) inside an AIS certified area. This certified area has an extension equal to the normal AIS radar range (the fact of "certifying the AIS data does not decrease the intrinsic efficiency of the AIS system). The AIS 13, is a co-operating transponder that provides a ship-shore communication channel on a VHF connection which is intrinsically unsecure (all the details of the structure of the messages are in the regulation ITU-R M.1371-1).

Said AIS unsecure connection allows the sniffing, spoofing and phishing, for example the pirates could simulate an attack to a non-existing ship to distract the attention making the emergency means and the allies units converge in a geographical zone which is distant from the point where the attack is actually delivered. The "time factor" can be highly determining for the outcome of an attack (usually the pirates does not have means suitable to face a reaction by the reinforcement means, they play instead on the surprise factor to attack merchant ship, oil tanker or the like). The innovative concept of "certified track" is introduced to the end of validating any information relevant to a track.

In the framework of the above-mentioned AIS standard (24 messages), the present invention uses some of the messages to assure the integrity of the communication. To this end, the invention utilises indifferently one or the other of the messages No. 8 and 6, which are available as text messages freely usable by anybody. A secret information (for example a key) is appended to the string of the 24 messages and a hash of the whole string is calculated. Afterwards, this hash is inserted in the chosen message (either No. 8 or No. 6) and the 24-messages string is sent to the wished user (shore headquarters).

The secret information is shared with the wished user, so that he/she can recognize the ship that is communicating.

The message 6 is used in the prior art to address oneself to the addressee, the message 8 is utilized to broadcast the information (all the AIS apparatuses). A further message 7 can be utilized by the headquarters to acknowledge receipt.

In this way, the AIS according to the invention will not function only for identifying the co-operating ship in the anti-piracy system, rather also for authenticating the identity provided by the AIS of the prior art. The VTS alone cannot provide this authentication, owing to the fact that the AIS could have been stolen or cloned or manipulated and installed on a ship that wishes to simulate to be co-operating. This because the identification information is not kept in the AIS.

It is here to be specified that the choice of the messages 6 and 8 is only a preferred embodiment of the authentication (preferred since it allows not to modify the current standard of the AIS messages and therefore the nowadays installed AIS infrastructure, which remains absolutely compatible with all the existing installations, by utilising precisely those messages that in the AIS standard are reserved as "free text"). It can be made in many different ways, reaching the same goal (for example in case of standard evolution).

In addition to the technical details utilized to secure the AIS connection, it is possible to compare the available information in the starting ports or in the international registers such as the navigation plan (spatial trajectory and time schedule) and the starting protocol with the information exchanged through the AIS connection and the data arriving from the optical processing (current navigation trajectory) to validate the correspondence of the dynamical information with the static information (for example the navigation plan) in real time.

Naval Level (Third Level)

In order to face the most critical events, the system according to the invention proposes to utilise a dedicated device called hereafter "safety box" (SB) 90, which has to be connected to the radar (and/or other sensors) already installed on the ship (typically utilising a limited set of standard interfaces) for example to the end of:

localizing the ship at any time;

detecting any deviation from the boundaries of the secure area and/or the navigation plan (in case of capture of the ship by the pirates), and possibly transmitting it to the VTS centres;

transmitting to the VTS centres the surveillance data about the watercrafts around the ship, acquired to improve the tactical framework extending the radar coverage (cf. FIGS. 5 and 6).

In order to perform the second operation of the list, the safety box can comprise a GPS or exploit the one already mounted on board, and comprises a geographical localisation module that comprises all the maps suitable to the end.

It is also utilised for extending the radar coverage from shore with the "ARPA" on board tracks (Automated Radar Plotter Aid) that arrive from the ship towards shore (making use of the safety box as described in the following). The safety box (SB) is a computerised device (commercial Windows® o Linux PC) that is equipped with dedicated software modules.

In particular, there are two software modules of interest:

the tracker 91, and the gateway 92 for the interface of the VHF subsystem, called VHF-GW (that could also be a gateway for a satellite connection for the data transmission).

The safety box 90 receives data from two input interfaces, one for the tracker 91 and another one 92 directly from the LAN (Local Area Network) of the ship, also called ship data bus (e.g. a serial data bus at 4800 baud), and sends its output to the VHF console (i.e. console or interface for the satellite system), which is the console of the VHF subsystem, again through the LAN of the ship.

The communication on the LAN of the ship is based on Ethernet technologies with standard protocols such as the NMEA messages (NMEA 0183 and 2000 managed by the national naval electronic association, www.nemea.org). On the other hand, if the ship does not have a modern data bus (LAN) but only an on-board radar connected directly to the ARPA console, a second input interface of the safety box is utilised to connect such an ARPA console directly to the tracker inside the safety box, producing radar tracks by means of a tracker 91 inside the safety box. Such tracks are produced in a pre-defined format and sent to the VHF-GW 92, which can transform them in a standard message such as the NMEA and then passes it to the VHF console of the subsystem VHF, or sends them directly through a dedicated interface whenever the VHF sub-system be predisposed and compatible. In this second scenario, the connection between the console of the ship (or of the merchant ship) and the safety box is realised by using a serial connection such as the standard connection RS-232 that could be suitable considering the short distance to cover. One observes here that the safety box is installed on board of the ship and usually could be positioned near the console of the ship.

Summarising, the aim of the safety box 90 is to produce radar and/or optical tracks (or of different type if the sensors on board are different) preferably in a standard format (for example NMEA). To this end, if the ship is—let as assume—a modern ship and already has radar tracks in the commercial format (for example NMEA) and a local network (Ethernet technology), the safety box is simply connected to the LAN of the ship and the tracks are forwarded to the VHF subsystem by using a sniffer. On the contrary, in all the other cases where there is not a tracker on the ship or there is no standard radar processing unit on the ship, la safety box is connected by using a serial cable (RS-232 or equivalent) directly to the naval console (ARPA) keeping the raw radar data and performing the same tracking function. In both cases, the output of the safety box is constituted by standard radar tracks (for example in the format NMEA) or in a proprietary format, which are sent to the shore system of the present invention utilising the VHF subsystem.

The commercial idea is based on the remark that the protection against piracy is an economical opportunity that is attractive for the clients and could be of interest for the VTS national administration and the ships' owners. Moreover, the assurance companies could reduce the fares for the cargo navigation and ships within areas affected by piracy as soon as they accept to subscribe said security service.

In the foregoing, the preferred embodiments have and variations of the present invention been described, but it is to be considered that those skilled in the art will be able to make modifications and other variations without departing from the scope of the invention, as defined by the enclosed claims.

The invention claimed is:

1. A maritime anti-piracy system, for recognition of suspect watercrafts around one or more co-operating ships to be protected, comprising:

a shore-based control system, comprising:

one or more centres, geographically distributed, comprising shore-based sensors for detecting watercraft surveillance data;

a central station for collecting and elaborating watercraft surveillance data;

the shore-based control system comprising a bi-directional communication network between said one or more centres and said central station, in such a way that said central station is able to send commands to said shore-based sensors;

a communication system between said one or more centres and said one or more co-operating ships to be protected, the maritime anti-piracy system further comprising:

one or more devices, mounted on board of said one or more co-operating ships to be protected, for maritime surveillance data extraction from maritime surveillance sensors, which are mounted on board of said one or more co-operating ships to be protected and are suitable to watch over a space around said one or more co-operating ships, said one or more devices for data extraction being suitable to send said maritime surveillance data to at least one of said one or more centres through said communication system;

an identification and authentication system of said one or more co-operating ships to be protected, which functions through said communication system and is shared among said one or more centres and each of said one or more co-operating ships to be protected, said central station elaborating the data coming from said one or more centres, and therefore also from said one or more co-operating ships to be protected, and launching relevant alarms in case of recognition of the suspect watercraft.

2. The system according to claim 1, wherein said maritime surveillance sensors comprise a radar mounted on board of said one or more co-operating ships to be protected.

3. The system according to claim 2, wherein said shore-based sensors comprise at least a shore camera and said maritime surveillance sensors comprise at least a camera, said central station elaborating video data coming from said shore-based sensors and said maritime surveillance sensors to obtain watercraft video tracks, including video tracks of said suspect watercraft and said one or more co-operating ships, which are elaborated together with at least one track coming from at least one shore AIS receiving device and said radar relevant to the suspect watercraft and the one or more co-operating ships, to improve the recognition of the suspect watercraft and the one or more co-operating ships.

4. The system according to claim 3, wherein said central station elaborates the video data from the camera to additionally obtain watercraft silhouettes and compares them with a series of pre-defined silhouettes relevant to known ships.

5. The system according to any claim 2, wherein each of said one or more devices for data extraction comprises:

a module for connecting to said maritime surveillance sensors, by means of a data bus or by direct connection;

a gateway module for connecting to a data transmission module mounted on board of said one or more co-operating ships for the sending of extracted data to shore through said communication system.

6. The system according to claim 5, wherein each of said one or more devices for data extraction comprises an extracted data elaboration module, which is suitable to prepare elaborated data to be transmitted through said gateway module.

7. The system according to claim 6, wherein said extracted data elaboration module also functions as an on board tracker, wherein data can be extracted from on board radar sensors.

8. The system according to claim 5, wherein said gateway module is suitable to operate towards a VHF radio data transmission module mounted on board of said one or more co-operating ships.

9. The system according to claim 5, wherein said gateway module is suitable to operate towards a satellite and/or a U/VHF radio transmission module, mounted on board of each of said one or more co-operating ships for sending of data to shore.

10. The system according to claim 5, wherein said gateway module comprises a sub-module for the management of commands and parameters relevant to the a radio communication, wherein selection of frequencies and radio channels to be utilised in said communication system can be handed over.

11. The system according to claim 5, wherein each of said one or more devices comprises two modules of connection to said maritime surveillance sensors:

a direct connection module, which extracts the data and represents them in a pre-defined format;

a bus indirect connection module, which is a sniffer for data extraction and data representation in a standard protocol.

12. The system according to claim 1, wherein said identification and authentication system comprises one or more AIS transmission devices mounted on said one or more co-operating ships, each of the one or more co-operating ships having an identity, and at least one shore AIS receiving device, each of the one or more AIS transmission devices being suitable to transmit information of authentication of the identity of one or more co-operating ship on which it is mounted to said shore AIS receiving device.

13. The system according to claim 12, wherein each of said one or more AIS transmission devices and each of said shore AIS receiving devices has an encryption unit associated, the encryption unit generates a key for authentication of AIS messages having a structure, without changing the structure of the AIS exchange messages.

14. The system according to claim 12, wherein said identification and authentication system a VHF communication with encrypted signature.

15. The system according to claim 12, wherein said identification and authentication system utilises either message No. 8 or message No. 6 of the AIS standard, being provided by electronic elaboration means, which appends a secret information to a string of 24 AIS messages and calculates a hash of the string obtained, said hash being inserted in either said message No. 8 or message No. 6, wherein the string of 24 AIS messages obtained is finally sent through said communication system.

16. The system according to claim 15, wherein said secret information is a cryptographic key.

17. The system according to claim 1, wherein each of said one or more devices utilises a GPS and a geographical localisation module, which is suitable to detect any deviation of the one or more co-operating ship to be protected from a boundary of a pre-determined secure area and/or from a navigation plan in case of capture of the co-operating ship, and is also suitable to transmit the deviation to a shore-based control system.

18. A device for maritime surveillance data extraction from maritime surveillance sensors including radar sensors, disposed within a ship to be protected against suspect watercraft in a space around the ship and configured to watch over the space around the ship, whereby said ship includes a data transmission device for sending data to a shore centre through an associated communication system, the device comprising:

a connection module for connecting to said maritime surveillance sensors, comprising:

a direct connection module, which extracts the data and calculates tracks; and a bus indirect connection module, which is a sniffer for tracks data extraction;

which produce elaborated tracks by representing tracks in pre-defined formats;

a gateway module connected to both said direct connection module and said bus indirect connection module, for connecting to said maritime surveillance sensors and configured to be connected to said data transmission device;

in such a way that, in use, said elaborated tracks are transmitted to shore through said gateway module.

19. The device according to claim 18, wherein said direct connection module calculates tracks for data from radar sensors and/or video sensors.

20. The device according to claim 18, wherein the device for maritime surveillance data extraction further comprises a geographical localisation module, which uses GPS information from the ship or from an integrated GPS, and comprises all maps to detect any deviation from boundary of a predetermined secure area and/or a navigation plan, data regarding the deviation being transmitted to shore through said gateway module.

21. The device according to claim 18, wherein said gateway module is suitable to operate towards a satellite and/or U/VHF radio transmission module, mounted on board of said ships for sending of data to shore, in particular towards a VHF radio data transmission module inside an AIS device mounted on board of said ship.

22. The device according to claim 18, wherein said gateway module comprises a sub-module for management of commands and parameters relevant to a radio communication, wherein the selection of frequencies and radio channels to be utilised in the communication to shore can be handed over.

* * * * *